United States Patent [19]

Hutner

[11] 4,006,985

[45] Feb. 8, 1977

[54] XEROGRAPHIC APPARATUS HAVING TIME CONTROLLED FUSING

[75] Inventor: Mark A. Hutner, Glenview, Ill.

[73] Assignee: Xerox Corporation, Stamford, Conn.

[22] Filed: Sept. 5, 1975

[21] Appl. No.: 610,725

[52] U.S. Cl. ..... 355/14; 219/216; 355/3 R

[51] Int. Cl.[2] ..... G03G 15/00

[58] Field of Search ..... 355/14, 3 FU; 219/216, 219/488, 492

[56] References Cited

UNITED STATES PATENTS

| | | | |
|---|---|---|---|
| 3,398,259 | 8/1968 | Tregay et al. | 219/216 |
| 3,505,497 | 4/1970 | Lawes et al. | 219/216 |
| 3,588,445 | 6/1971 | Hopkins | 219/216 X |
| 3,735,092 | 5/1973 | Traister | 219/216 X |
| 3,745,304 | 7/1973 | Hutner | 219/216 |
| 3,790,747 | 2/1974 | Klavsons | 219/216 |
| 3,881,085 | 4/1975 | Traister | 219/216 |

*Primary Examiner*—R. L. Moses
*Attorney, Agent, or Firm*—James J. Ralabate; Carlos Nieves

[57] ABSTRACT

Xerographic apparatus for reproducing information on selected one of periodically presented documents includes: means for providing print signals time associated with the selected documents; a paper web; toner; and means for providing toner images, corresponding to information on selected documents, on successive sections of the web. The web passes through a fuser assembly whose temperature is sensed and controlled. Control is accomplished with: (1) means responsive to said print signals, for turning the fuser on for periods of time related to intervals of time occurring between successive print signals, each of said periods of time occurring during an interval immediately prior to the presentation of a toner image, related to the first of successive signals, to the fuser; (2) means for turning the fuser on upon presentation of a toner image to the fuser; and (3) means responsive to the temperature in the fuser for inhibiting means (1) and (2) to turn the fuser off after specific timer periods.

11 Claims, 4 Drawing Figures

XEROGRAPHIC APPARATUS HAVING TIME CONTROLLED FUSING

This invention generally relates to electrophotographic equipment and more particularly to apparatus for automatically regulating the time during which a fuser is on in said equipment.

Electrophotographic reproducing techniques of the type described in detail in U.S. Pat. No. 2,297,691, issued to Chester F. Carlson, form electrostatic latent images of original documents by selectively dissipating a uniform layer of electrostatic charges deposited on the surface of a photoreceptor in accordance with modulated radiation images focused thereon. An electrostatic latent image thus formed is developed and transferred to a support surface to form a final copy of an original document. The development process is effected by applying electroscopic particles, conventionally known as toner, to the electrostatic latent image whereat such particles are electrostatically attracted to the latent image in proportion to the amount of charge comprising such image. Hence, the areas of small charge concentration are developed to form areas of low particle density, while areas of greater charge concentration are developed to form areas wherein the particle density is greater. Once transferred to the support surface, the developed image may be permanently fixed thereto by heat fusing techniques wherein the individual particles soften and coalesce when heated so as to readily adhere to the support surface.

Various modifications in fusing techniques have heretofore been developed which achieve diverse results, such techniques including selective fusing. Selective fusing contemplates the irregular, non-continuous, non-periodic operation of a fuser assembly in response to particular predetermined conditions. In this regard, selective fusing techniques are readily adapted to cooperate with selective xerographic printing techniques. Thus, if copies of only selected ones of successively scanned original documents are to be printed, a fuser assembly must be energized for each time the developed image of a selected original is transferred to the support surface. It is appreciated that if the support surface comprises a web of suitable material, such as paper, the web will be transported to the fuser assembly in an irregular manner corresponding to the scanning of the unique originals to be reproduced. Consequently, scorching or burning of the web that is stationarily disposed within the fuser assembly must be avoided, while, at the same time, sufficient heat must be accumulated in the assembly to assure adequate fusing of the toner areas to the web.

In the implementation of the aforementioned fusing technique, i.e., the fusing of successive toner areas disposed in image configuration upon an irregularly moving support surface, it has been found, that in addition to the problem of scorching the support surface, it is necessary to provide for a delay in raising the temperature of the fuser assembly to a proper value in response to the energization thereof, for the accumulation of heat within the assembly during the duration of energization thereof, and for the temperature to which the assembly has cooled in the time that has expired since the immediately preceding energization thereof.

Prior attempts at regulating a fuser assembly of the type herein contemplated in order to account for the foregoing has resulted in regulation without due consideration to the actual temperature in the fuser assembly or, as is the case in the apparatus disclosed in U.S. Pat. No. 3,851,144, have required variable power supplies constantly supplying either low or high levels of energy to a heating element.

It is an object of the present invention to provide apparatus for selectively fusing electroscopic particles to a support surface.

It is another object of the present invention to provide apparatus for regulating the on-off state of a power supply for a fuser assembly in accordance with time intervals related to the time elapsing between toner images fed to the assembly and the ambient temperature in the assembly.

A more specific object of the present invention is to provide energy to a fuser assembly, through which toner images move intermittently, during an interval of time occurring immediately prior to the presentation therein of a toner image, for a period of time directly related to multiples of said interval of time elapsing since the previous presentation of a toner image.

Apparatus assembled, according to the invention, includes: (a) a source generating light images and print signals associated with at least some of the images, any one of the print signals being associated with only one of the images; (b) a support base; (c) toner; (d) means for providing toner images, corresponding to light images associated with print signals, on successive sections of said support base; (e) a fuser assembly; (f) means, responsive to said print signals, for turning the fuser on for periods of time related to periodic intervals of time occurring between successive print signals, each of said periods of time occurring during an interval of time immediately prior to the presentation of a toner image, related to the first of the successive print signals, to the fuser assembly; (g) means for turning the fuser on upon presentation of a toner image to the fuser assembly; and (h) means responsive to the temperature in the fuser for inhibiting means (f) and (g) to turn the fuser off after specific time periods within said intervals of time.

Additional objects and features of the invention will become apparent by reference to the following description in conjunction with the accompanying drawings, in which.

Figure 3:
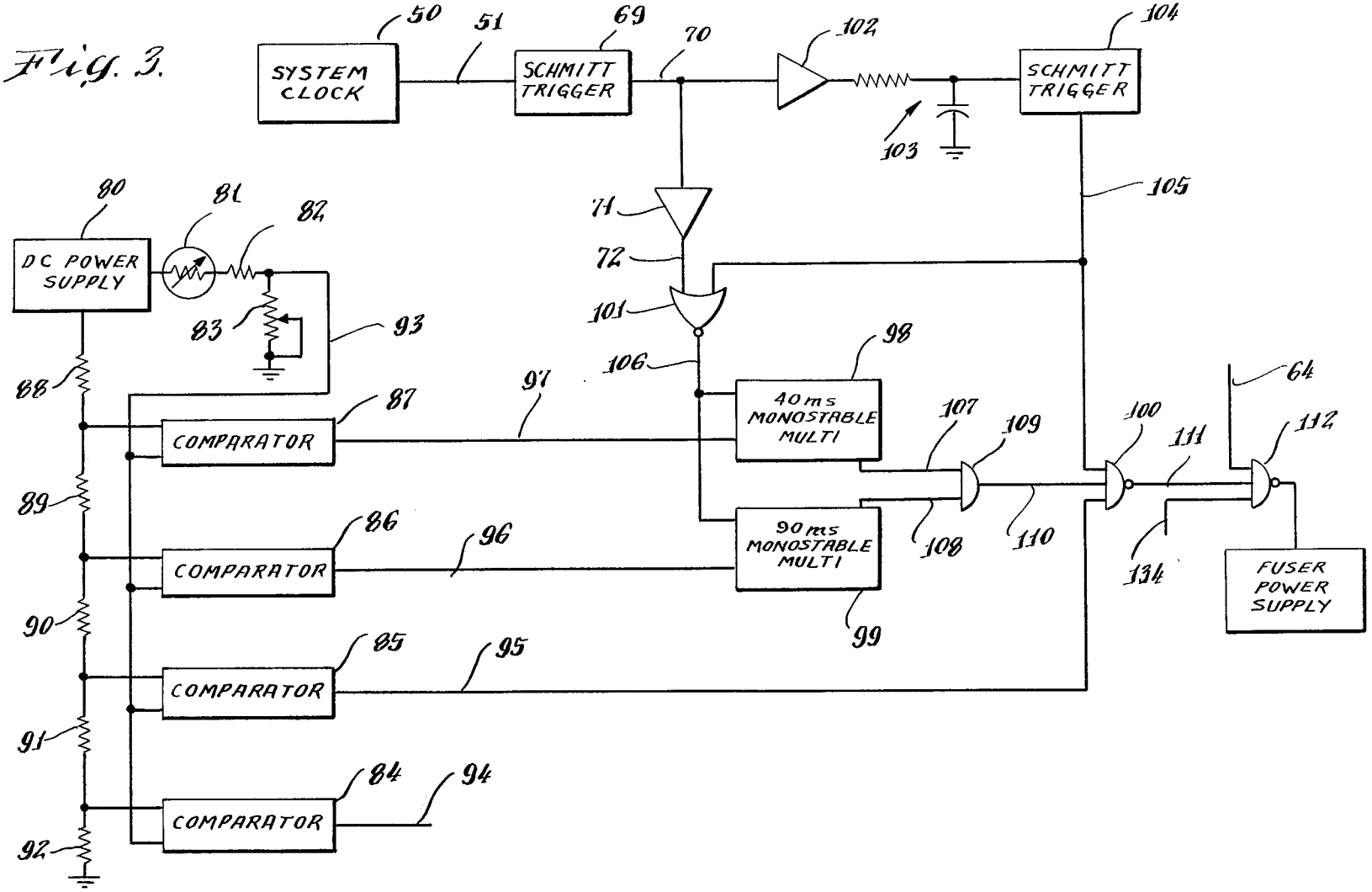
Figure 4:
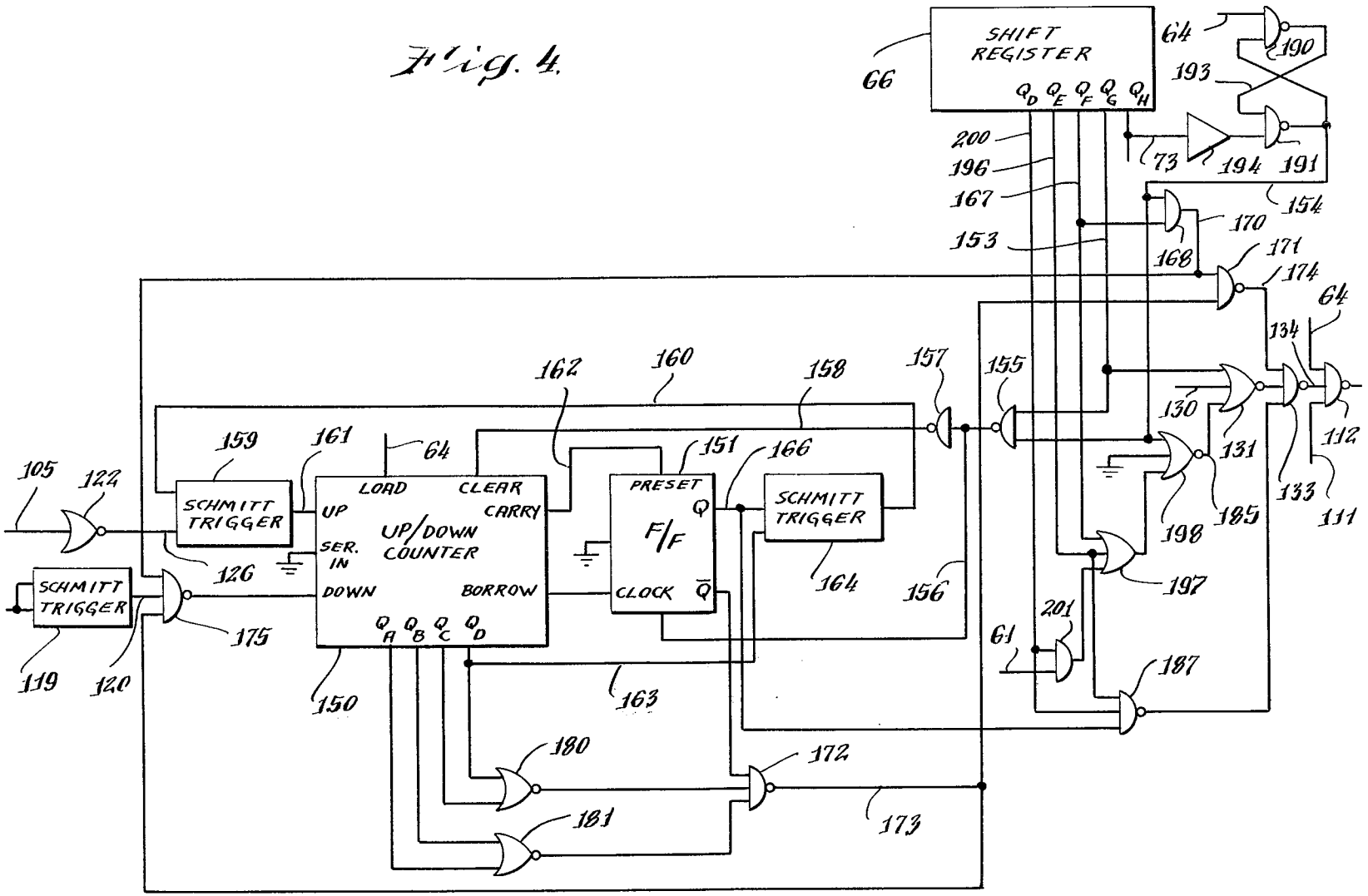

FIG. 3 is a partial schematic diagram of another part of the electrical circuit, the part shown including means for limiting the maximum fuser on time as a function of ambient temperature in the fuser assembly; and FIG. 4 is a partial schematic diagram of another part of the electrical circuit, the part shown including means for energizing the fuser for periods of time related to intervals of time occurring between print signals associated with images to be printed.

Figure 1:
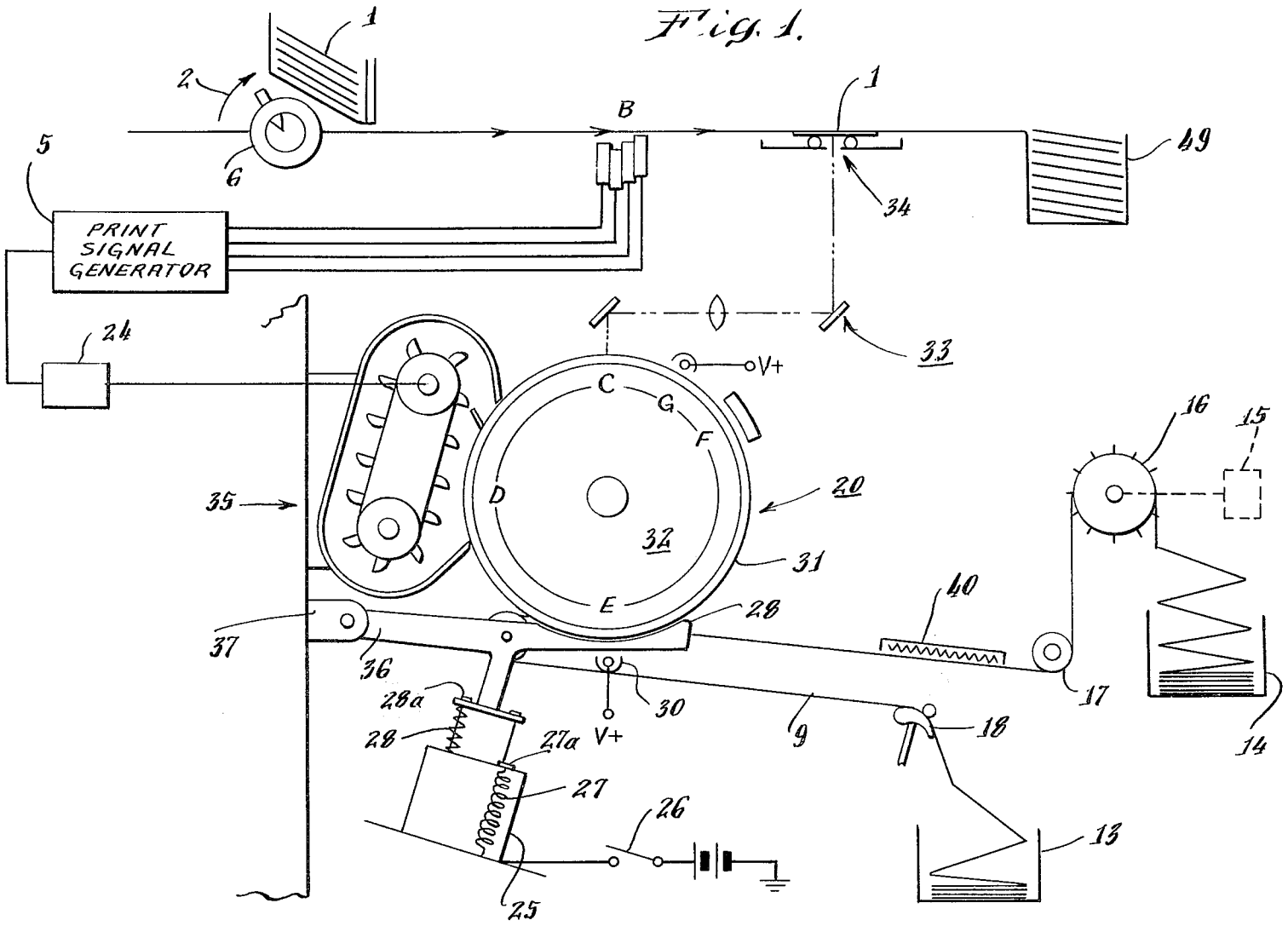
FIG. 1 is a schematic diagram of selective printing apparatus assembled in accordance with the subject invention.

For a general understanding of selective printing apparatus incorporating the invention herein reference is made to FIG. 1, in which some of the various system components for the apparatus are schematically illustrated. The selective printing apparatus comprises an electrostatic system wherein a light image of an original to be reproduced is projected onto the sensitized surface of a photosensitive plate to form an electrostatic latent image thereon. Thereafter, the latent image is developed with an oppositely charged developing material comprising electroscopic particles, known as toner particles, to form a powder image corresponding to the latent image on the photosensitive surface. The powder image is then electrostatically transferred to a support base to which it may be fixed by a fuser assembly whereby the powder is caused to adhere permanently to the support surface.

In the illustrated apparatus, visible document information is provided on each of the data cards 1 that are successively transported from a feeder tray 2 to a restack tray 49. The data cards are transported in timed sequence with respect to the operation of the remaining apparatus illustrated herein, and are caused to traverse scanning station B and slit exposure device 34 in successive order. Each data card is additionally provided with pre-coded information thereon, which pre-coded information is determinative of the selective printing of the visible document information carried by the card. More particularly, if the pre-coded information scanned from the card by scanning station B admits of a particular pre-condition, logic circuitry 5 responds to such scanned information to derive a print signal. The thus derived print signal is operated upon in timed sequence to provide a direct correspondence between the sequential manipulation of such print signal and the particular operation performed by the apparatus illustrated in FIG. 1.

The sequential passage of data cards from the scanning station B through the projection system 33 to the restack tray 49 will cause optical images of the visible document information on each of the data cards passing through the slit exposure device 34 to be sequentially projected upon the surface of photosensitive drum 20. The photosensitive drum 20 is continuously driven at a constant angular velocity such that the surface thereof is moving at a velocity equal to that of data cards moving past the exposure device 34. In moving in the direction indicated by the arrow prior to reaching the exposure station C, that portion of the photosensitive drum being exposed in uniformly charged by a corona discharge station G. The exposure of the photosensitive drum surface to the light image selectively dissipates the electrostatic charge on the surface thereof in the area struck by light, thereby forming an electrostatic latent image in image configuration corresponding to the light image projected from the visible document information on the data card transported through the slit exposure device 34. As the photosensitive drum surface continues its movement electrostatic image passes through a developing station D in which there is positioned a developing apparatus generally indicated by the reference numeral 35.

If the electrostatic latent image passing through developement station D is derived from a data card having a print signal associated therewith, such print signal is utilized to activate the developer motor 24 such that the developing apparatus may be operated to develop such such electrostatic latent image. In contradistinction thereto, should the electrostatic latent image passing through the developing station D be derived from a data card not having a print signal associated therewith the developer motor 24 is not activated and such electrostatic latent image is not developed. Therefore, it should be appreciated that the developing apparatus 35 is operated in an intermittent manner wherein only those electrostatic images derived from data cards having print signals associated therewith are developed at station D. As the photosensitive drum 20 continues to rotate in the direction indicated by the arrow successive areas thereof will be provided with image information distributed thereon in the form of a distributed electrostatic charge pattern. However, only selected ones of successive areas will be developed. As illustrated herein, the developing apparatus 35 may typically be provided with electroscopic particles that are cascaded across the surface of photosensitive drum 20, which particles are attracted electrostatically to the distributed charge pattern to form powder images.

The developed electrostatic image is transported by the photosensitive drum 20 to a transfer station E located at a point of tangency on the photosensitive drum whereat a support base 9 is intermittently moved at a speed in synchronism with the moving drum in order to accomplish transfer of the developed image. The support base 9 is here depicted as a web comprised of suitable material, such as paper, driven from a supply bin 13 to selective transfer mechanism 25, through fuser assembly 40, about strip driving means 16 and into a strip receiving tray 14. It will be appreciated that the support base 9 may also comprise a continuous strip of paper having gummed labels supported thereon which can be readily removed from the web subsequent to the reproducing operation. At the time a developed image having a print signal associated therewith arrives at the transfer station E, the associated print signal is operated upon to cause the web driving means 16 to be activated, thereby transporting the support base 9 at a velocity equal to the surface velocity of the photosensitive drum 20. Moreover, the print signal is used to operate the selective transfer mechanism 25 whereby the support base 9 engages the photosensitive drum 20 in an arc contact. In addition, charging means 30 may be energized to provide a charge on the support base 9 prior to its engagement with the photosensitive drum so that the developed image may be electrostatically transferred from the surface of drum 20 to the adjacent side of the support base as such support base is brought into contact therewith. Thus, it is seen, that each developed electrostatic image is transferred to the support base 9; and the support base is, therefore, advanced in an intermittant manner in accordance with each print signal that is derived from the scanning information carried by the transported data cards.

After transfer, the support base 9 is transported to the fuser assembly, generally indicated by the reference number 40, wherein the developed and transferred powder image on the support base is permanently fixed thereto. Fuser assembly 40 is comprised of one or more ribbon heating elements adapted to emit a suitable amount of heat when energized. The dimensions of the assembly may be such as to admit of a plurality of transferred images to be disposed therein simultaneously. The print signal derived from a data card is operated upon in a pre-selected sequential manner in correspondence with the transporting of a transferred image to the fuser assembly 40. Since, however, immediately succeeding areas of the support base 9 are provided with transferred images, but succeeding ones of the data cards are not necessarily provided with the unique pre-coded scanning information, it is recognized that the support base is moved intermittently through the fuser assembly in an irregular manner. In general, the fuser assembly must not be continuously energized to avoid scorching of the support base that is maintained in a temporary stationary relationship with respect thereto. Nevertheless, as an immediately succeeding portion of the support base is advanced to the fuser assembly, the latter must be energized to an operating level capable of fixing the electroscopic powder image upon the support base. The manner in which the fuser assembly 40 is regulated to provide the just-mentioned selective fusing is described in detail hereinbelow.

The excess electroscopic particles remaining as residue on the developed images, as well as those particles not otherwise transferred therefrom, are carried by the photosensitive drum 20 to a cleaning station F on the periphery of the drum adjacent the charging station G. The cleaning station may comprise a rotating brush and a corona discharge device for neutralizing charges remaining on the non-transferred electroscopic particles. Various other configurations and components may comprise a cleaning station F as is well known to those skilled in the art. A more complete description of the selective printing apparatus illustrated in FIG. 1, and the manner in which such apparatus operates, is set forth in detail in U.S. Pat. No. 3,743,779, issued to Mark A. Hutner on July 3, 1973 and assigned to Xerox Corporation, the assignee of the present invention.

Referring to FIG. 1, intermittent movement of the support base 9 in accordance with print signals and continuous motion of the support base to remove printed sections of the support base located within the machine at the end of a run is accomplished with a single revolution clutch 15 coupled to the support base driving means 16. In turn, clutch 15 is controlled with a logic circuit responsive to a system clock 50 (see FIG. 2) and generated command signals. More specifically, clock 50 provides on line 51 a positive pulse signal having a duration of 190 ms. and a period of 330 ms. As will become apparent the 330 ms. period is the interval of time required to translate successive sections of the support base to the fuser assembly and is the reciprocal of the data card feed rate. With respect to command signals, a start responsive signal generator 52 provides a command signal on line 53 such that whenever the machine is started a binary "1" is provided for approximately 100 ms; a feed responsive signal generator 54 provides a command signal on line 55 such that a binary 1 exists thereon except when a strip feed button on the machine is depressed; and a print data signal generator 56 provides a command signal which is syncronized with print signals to provide on line 57 binary "0"s three clock cycles after print selections and binary 1s during other periods. In the logic circuit, line 53 is connected to an input of NAND gate 58; line 57 is connected to an input of a NAND gate 59; and line 55 is connected to a Schmitt trigger 60 which squares and inverts, the output of the trigger 60 being connected via line 61 to the input of an inverter 62. The output of inverter 62 is connected via line 63 to inputs of NAND gates 58 and 59. The output of NAND gate 58 is connected via line 64 to the present and clear inputs, respectively, of a flip-flop 65 and shift register 66, the Q output of flip-flop 65 being connected by line 67 to serial inputs of the shift register, and the output of NAND gate 59 is connected by line 63 to the D input of flip-flop 65. Line 51 is connected to a Schmitt trigger 69, which squares and inverts, and the output of trigger 69 is connected via line 70 to inverters 71 and 102. The output signal of inverter 71 is connected by line 72 to the clock inputs of flip-flop 65 and shift register 66. Thus, it may be seen that when the machine is turned on the binary 0 generated on line 64 by the temporary binary 1 on line 53 and the binary 1 on line 55 presets the Q output of flip-flop 65 and causes all the outputs of shift register 66 to go low. In addition, when the machine is started, the system clock is activated and as a result the Q output of flip-flop 65, i.e., a binary 1, is propagated through the shift register 66. With binary 1s present on lines 63 and 56 binary 0s are propagated through the shift register. However, whenever a binary 0 appears on line 57, corresponding to a print signal, or when the strip feed button is depressed, a binary 1 is propagated in the shift register. If the strip feed button is held in a depressed condition a series of binary 1s is propagated down the shift register. The last stage $Q_H$ of shift register 66 is connected by a line 73 to an input of a NAND gate 74 and an input of a NAND gate 75. Further, the next to the last stage $Q_G$ of the shift register is connected by line 153 to NAND gate 75. The output of NAND gate 74 is coupled by a low-pass RC network to an input of AND gate 76 and the output of NAND gate 75 is coupled by another RC network to another input of AND gate 76. The output of AND gate 76 controls the single revolution clutch. Operatively, when a binary 1 is at $Q_H$ and a binary 0 is at $Q_G$ a binary 1 which appears periodically for 190 ms. on line 72 causes the output of AND gate 76 to go low for 190 ms. to activate the clutch. More specifically, the low 190 ms. signal on line 72 activates within the clutch a solenoid which releases a powered shaft for a complete revolution. The shaft is coupled to the support base driving means and, accordingly, the driving means advances a section of the support base. If a binary 1 is also present on $Q_H$, the output of the AND gate remains low during the remaining period of the clock signal. Naturally, when a shift occurs in the shift register 66 the binary 1 in $Q_G$ shifts to $Q_H$ and the binary low on AND gate 76 remains for at least another 190 ms., depending on the new state of $Q_G$. It will be appreciated by those skilled in the art that when a steady stream of binary 1s are being supplied by the shift register 66 the output of gate 75 provides a binary 0 level which causes the output of gate 76 to provide a binary 0 level and the clutch 15 remains energized. Thus, chatter which would occur if the clutch were activated on every system cycle is eliminated. When the machine is started the binary 1 propagated through the shift register will shift an unprinted section of the support base through the machine. This segment may be used to identify machine runs. In view of the foregoing it should now be appreciated by persons skilled in the subject art that each print signal will cause a shift in the support base and that activation of the strip feed button will advance a section of the support base or multiples of the section through the machine at the clock rate. The latter is particularly useful at the end of a run when it is desired to move the last printed section out of the machine.

Fuser assembly 40 is supplied with electrical power on a cycle by cycle basis, the amount of time during each cycle (≈330 ms.) that the fuser is on being controlled with logic circuitry responsive to the temperature in the fusing chamber and the evolving print signal pattern. More specifically, the logic circuitry controls the maximum possible fuser on time for any machine cycle; the fuser on time during nonfusing cylces; the fuser on time during fusing cycles; and the fuser on time for a cycle prior to a fusing cycle.

In the subject embodiment, the maximum possible fuser on time is limited to fixed times, i.e., 330 ms., 280 ms., 230 ms., or 190 ms., corresponding to, respectively, temperatures in the fuser below 75° C, below 95° C, below 115° C, or above 115° C. In general, this is accomplished by providing an electrical voltage related to the temperature in the fuser, by comparing the electrical voltage with reference voltages to provide binary command signals and by using the command signals to drive logic components which control the time during which electrical power is supplied to the fuser. FIG. 3 shows a D.C. power supply 80 connected to one end of a thermistor 81, the other end of the thermistor being connected to one end of a resistor 82. The other end of resistor 82 is coupled to ground by a potentiometer 83 and, via line 93, to comparators 84–37. Potentiometer 83 may be used initially to adjust the voltage applied to the comparators for a particular fuser temperature. Physically, thermistor 81 is located within the fuser assembly and as a result the voltage applied to comparators 84–87 is a function of fuser temperature. Power supply 80 is connected to one end of a resistor 88 and the other end of resistor 88 is connected to comparator 87 and one end of resistor 89. The other end of resistor 89 is connected to comparator 86 and to one end of a resistor 90. The other end of resistor 90 is connected to comparator 85 and to one end of a resistor 91. The other end of resistor 91 is connected to comparator 84 and is coupled to ground by resistor 92. Thus, it may be seen that the power supply 80 and resistors 88–92 provide the reference voltages to comparators 84–87. If, for example, power supply 80 provides −12 volts, thermistor 81 and resistors 82, 83 may have values such that the voltage on line 93 may have values of −2.3v, −4.6v, −6.95v, and −8.5v corresponding, respectively, to temperatures of 55° C, 75° C, 95° C, and 115° C at thermistor 81. Under these circumstances, the values of resistors 88–92 may be chosen to provide reference voltages of −2.3v, −4.6v, −6.95v, and −8.5v, respectively, to comparators 84–87. Comparators 84–87 are similar and provide a binary type output. In particular, output line 97 of comparator 87 provides a binary 0 or a binary 1 when, respectively, the voltage on line 93 is more positive or less positive than the applied −8.5v reference; output line 96 of comparator 86 provides a binary 0 or a binary 1 when, respectively, the voltage on line 93 is more positive or less positive than the applied −6.95v reference; output line 95 of comparator 85 provides a binary 0 or a binary 1 when, respectively, the voltage on line 93 is more positive or less positive than the applied −4.6v reference; and output line 94 of comparator 84 provides a binary 0 or a binary 1 when, respectively, the voltage on line 93 is more positive or less positive than the applied −2.3v reference. Lines 94–97 are connected to logic components and the temperature related binary signals thereon control the maximum time per system cycle that the fuser may be on. More specifically, line 97 is connected to 40 ms. monostable multivibrator 98; line 96 is connected to 90 ms. monostable multivibrator 99, line 95 is connected to an input of a NAND gate 100; and line 94 is connected to an inverter 127 (see FIG. 2). Line 72 is also connected to an input of a NOR gate 101 and line 70 is coupled by a series arrangement including inverter 102, a 1 ms. RC delay circuit 103 and an inverting and squaring Schmitt trigger 104 to an input of NOR gate 101 and NAND gate 100. As a result the output of NOR gate 101 applies, via line 106, to multivibrators 98 and 99 a positive 1 ms. pulse immediately after the end of each 190 ms. pulse from the system clock 50 and Schmitt trigger 104 applies, via line 105, a 1 ms. delayed and inverted replica of the clock signal to NAND gate 100. The outputs of multivibrators 98 and 99 are connected via lines 107 and 108, respectively, to an AND gate 109 and the output of gate 109 is connected by line 110 to NAND gate 100. In turn, the output of NAND gate 100 is coupled, via line 111, to an input of a NAND gate 112 which controls the fuser on time. Operatively, when the temperature in the fuser is less than 75° C comparator 85 provides a binary 0 on line 95 and the resulting binary 1 on line 111 enables fusing during a complete system cycle. When the temperature in the fuser is greater than 75° C but less than 95° C comparator 85 provides a binary 1 on line 95 and comparators 86 and 87 each provide, via lines 96 and 97, respectively, binary 0 signals. As a result, when comparators 86 and 87 receive, via line 106, the positive 1 ms. pulse binary 0s of 40 ms. and 90 ms. appear on lines 107 and 108, respectively, and a binary 0 appears on line 110 during the 90 ms. interval. Since prior to the occurrence of the 90 ms. interval a binary 0 is applied to NAND gate 100 on line 105 for about 190 ms. and since a binary 1 is provided on all of the inputs to NAND gate 100 during the period after the 90 ms. interval and before the next cycle, a binary 1 enabling fusing appears on line 111 for about 280 ms. When the temperature in the fuser is greater than 95°C but below 115°C comparators 85 and 86 each provide, via lines 95 and 96, respectively, a binary 1 and comparator 87 provides a binary 0. The binary 1 on line 96 inhibits multivibrator 99 and, as a result, the positive 1 ms. pulse only provides a 40 ms. binary 0 on line 110. In consequence, a binary 1 enabling fusing appears on line 111 for about 230 ms. When the temperature in the fuser is greater than 115°C comparators 85–87 each provide via lines 95–97, respectively, binary 1 signals, multivibrators 98 and 99 are inhibited and a binary 1 enabling fusing appears on line 111 for about 190 ms.

Figure 2:
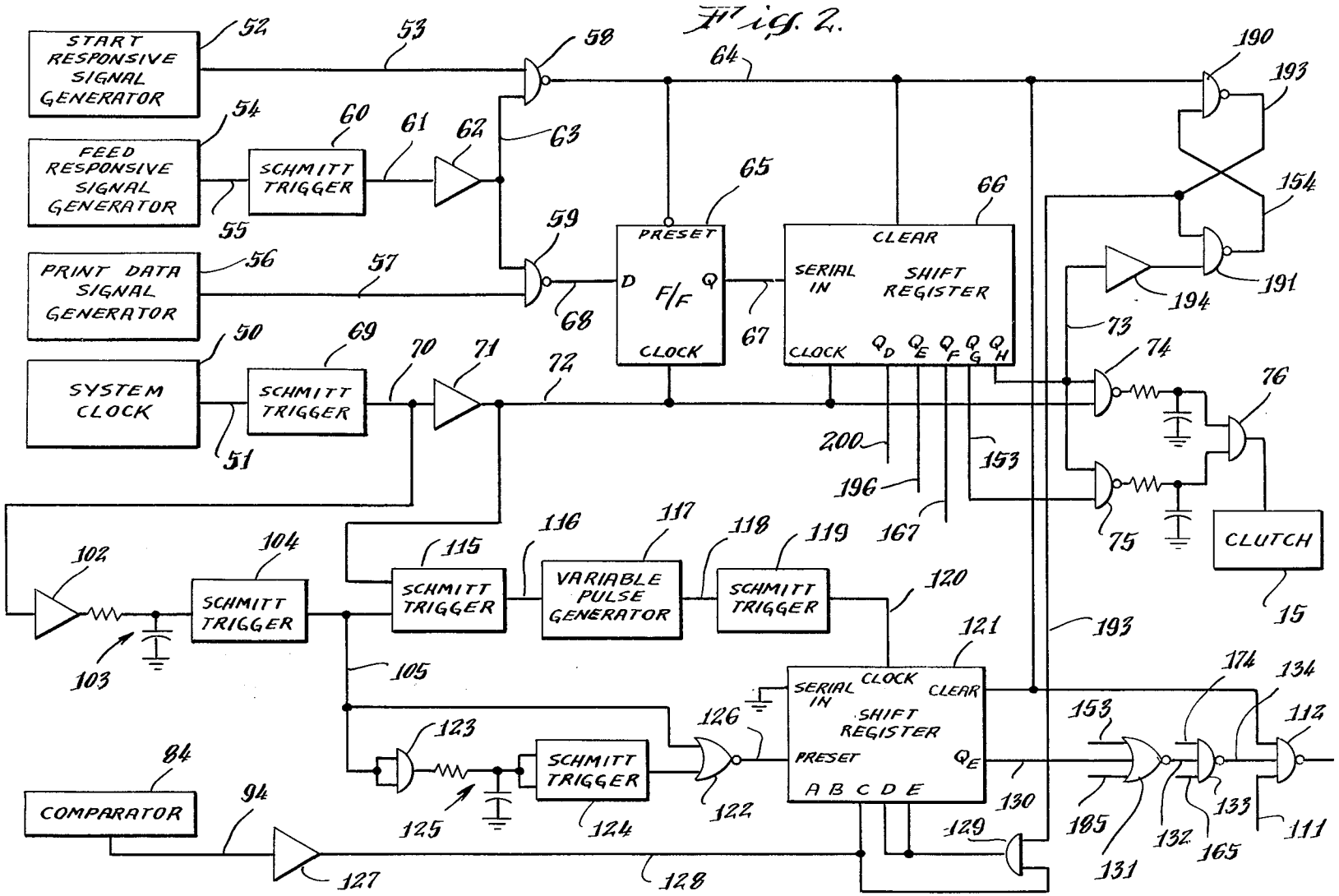
FIG. 2 is a partial schematic diagram of an electrical circuit, the part shown including means for driving a support base through a fuser of the apparatus and means for keeping the fuser element warm.

When the machine is not imaging it is desirable to maintain the temperature in the fuser element cool enough to avoid scorching a support base and warm enough to minimize the time required to bring the temperature of the element up to a fusing level. Referring to FIG. 2, this is accomplished as follows: lines 72 and 105 are connected to a Schmitt trigger 115 and as a result its output line 116 provides 1 ms. binary 0 pulses immediately after the beginning of each system cycle. Line 116 is connected to a variable pulse generator 117 which is triggered on by the binary 0 1 ms. pulse and periodically provides, on line 118, binary 0 pules 0.3 ms. wide, the first of such pulses occurring at a time equal to 1.6 times the period of the generator. Nominally, the period of said 0.3 ms. pulses is 20 ms. Line 118 is coupled by a Schmitt trigger 119 and line 120 to the clock input of a 5-bit shift register 121. Line 105 is also connected to an input of a NOR gate 122 and to both inputs of an AND gate 123. The output of AND gate 123 is coupled to both inputs of a Schmitt trigger 124 by a 3 us. delay RC network 125 and the output of trigger 124 is connected to an input of NOR gate 122. Therefore, the output of gate 122, which is connected to the preset-enable input of register 121 by line 126, provides a 3 us. binary 1 pulse 1 ms. after the beginning of each system cycle and loads the register stages A–E. Stages A and B are left floating in a binary 1 state; stage C is loaded with a binary 1 state when the temperature in the fuser is less than 55°C and with a binary 0 state when the temperature in the fuser is greater than 55°C; and, as will be described hereinafter, after start up stages D and E receive binary 0 signals from AND gate 129. The serial input of register 121 is grounded and, therefore, binary 0s are loaded into stage A with each pulse provided on line 120. As a result, the output of the register 121, on line 130, provides a 60 ms. positive pulse when the fuser temperature is less than 55° C and a 40 ms. positive pulse when the fuser temperature is greater than 55° C, one or the other of these pulses occurring during the first 190 ms. of each cycle. Line 310 is connected to a NOR gate 131 whose output is connected by line 132 to a NAND gate 133, the output of gate 133 being connected by line 134 to NAND gate 112. The other inputs to gate 112, on lines 64 and 111, are at a binary 1 level for at least the first 190 ms. of each cycle and, therefore, the fuser is turned on for 40 or 60 ms. depending on the temperature in the fuser. It should be noted that the fuser on time is multiple of the period of the timing pulses on line 121 and, to accommodate for different support bases or ambient conditions, may be varied. Typical period variations may range from 14 ms. to 35 ms.

In the absence of print signals the fuser is only turned on for 40 ms. or 60 ms. during each cycle and this is enough to keep the fuser element in a ready for fusing state if only a few machine cycles have elapsed since the previous fusing cycle. However, the interval of time between fusing cycles is not controllable and the amount of time it takes to bring the ribbon to a fusing temperature is directly related to the time elapsed since the previous fusing cycle. Therefore, to provide proper fusing temperatures, the subject embodiment includes means for controlling the time during which power is applied to the fuser in a pre-fusing cycle. Obviously, the minimum time is 40 or 60 ms. and the maximum time is limited by the maximum fusing cycle times previously described, i.e., 330 ms., 280 ms., 230 ms., and 190 ms. corresponding to fuser temperatures of up to 75° C, 95° C, 115° C and above 115° C, respectively. The Q outputs of shift register 66 (see FIGS. 2 and 4) are related, as a function of time, to received print signals and the output of each of stages $Q_D$ –$Q_G$ may be used to predict how the support base will be moved through the fuser. Therefore, shift register 66 is used to drive circuitry which applies power to the fuser in a pre-fusing cycle.

The pre-fusing cycle circuitry includes a reversible up-down counter 150, a flip-flop 151 which increases the count range, and a number of gates. Since the amount of time needed to preheat a fuser is proportional to the number of non-fusing cycles since the last fusing cycle, the number of non-fusing cycles are counted. As a practical limit the highest non-fusing cycle count needed is 24. Operatively, each time a non-fusing group of cycles begins the counter is reset. It then counts each non-fusing cycle up to a selected limit and stops. When the register 66 indicates that fusing is to occur in the next cycle the pre-fusing cycle begins and the fuser is turned on until the countdown reaches zero. Nominally, the time between counts is 20 ms., the same as is used in keeping the heater element warm. However, the actual time can be adjusted from 14 ms. to 35 ms. to compensate for machine differences, atmospheric conditions, paper types, etc.

More specifically, the pre-fusing circuitry functions as follows. Referring to FIG. 4, with a binary 1 provided by $Q_G$ of register 66 on line 153 and in view of the fact that line 154 provides a binary 1 except during startup, which will be described hereinafter, the ouput of NAND gate 155 provides a binary 0. The output of gate 155 is connected by line 156 to the clear input of flip-flop 151, resetting Q to a binary 0 level. Line 155 is also connected to the input of a NAND gate 157 and the ouput of gate 157, via line 158, provides a binary 1 which appears on the clear input of counter 150 and resets its outputs to binary 0 levels. As will be appreciated, this signal overrides count inputs.

If a binary 0 group begins after the binary 1 on $Q_G$ the resets will be removed on the leading edge of the next machine cycle. The clear on counter 150 will go to a binary 0 level and the clear on flip-flop 151 will go to a binary 1 level. As previously stated, about one 1 ms. after each new system cycle has begun a 3 us. wide pulse is generated at the output of NOR gate 122. This signal appears, via line 126, at the lower input of Schmitt trigger 159. The upper input, line 160, of trigger 159 is at a binary 1 level until a count of 24 is reached; therefore, a binary 0 pulse, 3 us. wide, is generated at the ouput of counter 150. This count up pulse will continue until a count of 24 is reached, one pulse for each system cycle occurring just after the leading edge of each system clock cycle occurs. After reset the outputs $Q_A$, $Q_B$, $Q_C$, and $Q_D$ of counter 150 are at binary 0 levels as is the Q output of flip-flop 151. The outputs $Q_A$ – $Q_D$ provide a binary count up to 16 and a count up pulse which appears on a cycle when all the outputs are at binary 1 levels on counter 150 causes a binary 0 pulse, as wide as the count up pulse, to appear on the carry output line 162. This signal appears on the preset input of flip-flop 151 and causes its Q output to go to a binary 1 level. The count up pulse also causes the counter 150 to reset to the 0 count, i.e., all outputs at a binary 0 level. The count will continue up until at the count of 24 the $Q_D$ output of counter 150 goes to a binary 1 level. This level appears, via line 163, on the lower input of Schmitt trigger 164. Since the upper input of Schmitt trigger 164, line 166, goes to a binary 1 level at the count of 16, the output of Schmitt trigger 16 goes to a binary 0 level and this appears, via line 160, at the upper input of Schmitt trigger 159. This provides a binary 1 level on line 161 regardless of the level on line 126, inhibiting further counts to the count up input. The counter will remain in this state until as described hereinafter a binary 1 occurs on line 167. In many cases, the print signal pattern will not permit the counter to reach the full count of 24, but the operation of the system is similar. The countdown cycle, which begins when the next binary 1 occurs on line 167, operates with any count on the up/down counter.

In the following description a count of 16 is assumed and a countdown cycle time of 20 ms. controlled by pulse generator 117, is used. This time will allow about 16 countdown cycle. Obviously, if the countdown cycle were 14 ms. long, approximately 22 cycles could be completed in one machine cycle (330 ms.). On the other extreme, only about 9 cycles could be completed if the cycle time were 35 ms. If the counter has a count higher than can be reached in one machine cycle, the additional counts are lost. This occurs because when countdown is initiated the count may not reach zero before the end of a countdown cycle and the following machine cycle will reset the counter to zero in preparation for another count up.

In a countdown cycle a binary 1 enters the $Q_F$ stage of shift register 66. This level appears, via line 167, on another input of AND gate 168. Since line 154 is at a binary 1 level except during start up, the output of gate 168 will provide on line 170 a binary 1 level. This level appears on the upper input of NAND 171. If the count on the up/down counter 150 is not zero, the output of NAND gate 172 will be a binary 1 level and this level is provided, via line 173, to NAND gate 171. With both inputs at binary 1 levels the output of gate 171 provides a binary 0 which appears, via line 174, as an input to gate 133 and causes its output to go to a binary 1 level. Recalling that line 64 provides a binary 1, except during standby, and a binary 1 is provided on line 111 until a maximum time, related to fuser temperature, is reached, it should now be apparent that the fuser will remain on until counter 150 counts down to zero or the maximum fusing time per machine cycle has been reached.

About 1 ms. into the countdown cycle a count up pulse will be generated at the count up input of counter 150 and will increase the count from 16 to 17. The up count will occur in every machine cycle, although it will be overriden by the clear input when binary 1s are in the $Q_G$ stage of shift register 66. As mentioned above, the output of gate 168 is at a binary 1 level during preheat cycle and,, via line 170, appears at the input of NAND gate 175. The output of gate 172 is also at a binary 1 level when the count is not zero and its output appears, via line 173, on the lower input of gate 175. At the start of a machine cycle the output of generator 117 is at a binary 1 level and this appears as a binary 0 on the output of Schmitt trigger 119. This binary 0 level appears, via line 120, on the input of NAND gate 175 and drives its output to a binary 1 level. However, when the period of the generator is 20 ms. the first pulse out is 1.6 times later or 32 ms. and at this time a negative or binary 0 pulse appears on the output of the generator. This is inverted by Schmitt trigger 119 and for the duration of this pulse the output of gate 175 will generate a binary 0 pulse of about 0.3 ms. duration. This pulse appears on the countdown input of counter 150 and it counts down one count.

A countdown cycle proceeds with each binary 0 pulse from the generator 117. As previously stated, the first pulse occurs 1.6 times the nominal cycle time, and subsequent pulses are at the cycle time rate. The NOR gates 180 and 181 decode the outputs of the counter 150 and the outputs of these gates are at binary 1 levels when both inputs to each are at binary 0 levels. The only time the output of both gates 180 and 181 are at binary 1 levels simultaneously is when all the outputs of counter 150 are at binary 0 levels. For counts below 16 the $\overline{Q}$ output of flip-flop 151 is at a binary 1 level. Therefore, for a zero count on the counter, all the inputs to gate 172 will be at binary 1 levels and will cause it outputs, on line 173, to go to a binary 0 level. In consequence line 174 provides a binary 1 to gate 133 and because its other inputs will be at binary 1 levels and its output will provide a binary 0 level which turns off the fuser. The binary 0 on the output of gate 172 will cause the output of gate 175 to remain at a binary 1 level and prevents any additional countdown signals from reaching the countdown input of couter 150. The system will remain in this state until the end of the machine cycle. Had the initial count been lower, the countdown cycle would have been completed sooner. If it were longer it would have been completed later or possibly not at all. In any case, the binary 1 on line 167 of shift register 66 will move to line 153 on the next machine cycle, and this will reset the counter 150 and flip-flop 151 to zero.

Primary fusing occurs when a binary 1 reaches the $Q_G$ stage of shift register 66 and fusing time in this cycle is limited only by the maximum on time per cycle. More specifically, the output of the $Q_G$ stage of shift register 66 appears, via line 153, on the upper input of NOR gate 131. With a binary 1 on line 153 the output of gate 131 will provide a binary 0 on an input of NAND gate 133 and its output will provide a binary 1 level. This level will appear, via line 134, on the input of gate 112. Therefore, the output of gate 112 will go to a binary 0 level and turn on the fuser until the maximum fuser on timer per cycle has been reached.

The preceding describes electrical power control occurring in the primary fusing cycle and in the pre-fusing cycle. During normal operation there is one exception to the described mode of operation. In the event that at least 16 cycles have occurred since the last print signal and at least two time adjacent print signals follow this non-print group, additioanl fusing will be required, and it will occur in the cycle before preheat. The need for additional fusing arises because in this embodiment the fusing chamber selected is about 3 inches wide. If print signals occur one at a time, there are three distinct start stop support base motion cycles in which 1 inch support sections can be fused. If these signals occur in groups, the time spent in the fusing chamber is reduced. In other words, the time spent absorbing energy from the preheat cycle and also as the fuser is cooling down, is substantially reduced for three consecutive print signals and reduced for two consecutive signals. NAND gate 187 controls the fuser for this extra heat cycle. If at least 16 cycles go by without a print signal, the Q output of flip-flop 151 will be at a binary 1 level and appears, via line 188, on an input of gate 187. In addition, when the two successive print signals provide binary 1 levels at the $Q_D$ and $Q_E$ stages these binary signals will appear on the inputs of gate 187 and cause its output to provide a binary 0 level, thereby turning on the fuser. The amount of time the fuser will remain on will be controlled by the maximum on time per cycle.

If the machine has been off for at least a few seconds when operation occurs, the fuser element is considered cold because no electrical power has been applied to it for at least a few seconds. To compensate, for the first print signal, the fuser is provided a longer on-time keep-warm cycle for a few machine cycles. Also the pre-fusing cycle on the second print signal is the maximum possible, even if the second print signal closely follows the first print signal. These steps are necessary to provide adequate fusing under adverse conditions. The specifics of how this is accomplished is set forth below.

As previously stated, when the cyclical operation begins one blank section is provided at the beginning of the substrate. This happens as a consequence of presetting the flip-flop 65 when it is cleared. This flip-flop stores the fact that the machine is the startup mode. During standby, the output of the NAND gate 58 (see FIG. 2) is at a binary 0 level, thereby: resetting the shift register 66, presetting flip-flop 65 setting the flip-flop provided by NAND gates 190 and 191, inhibiting gate 112, resetting the shift register 121, and loading counter 150. Counter 150 will store the count of 15 when loaded because parallel inputs, not shown, are left floating in binary 1 states. A binary 0 on the load input causes the binary 1s on the parallel inputs to be transferred to respective register states. When the flip-flop provided by gates 190 and 191 is set the output of gate 190 goes to a binary 1 level and is connected to input of gate 191 by line 193. The other input of gate 191 is at a binary 1 level because the output of the shift register stage $Q_H$ is at a binary 0 level which is inverted by inverter 194. The binary 1s on the inputs of gate 191 causes its output to go to a binary 0 level which appears, via line 154, on an input of gate 155, thereby providing a binary 1 level on line 156. As a result, the clear of counter 150 is released. Therefore, when the machine is started, the load input of counter 150 is released and the counter will count to 24. The clear input to the counter is inhibited during startup by the binary 0 applied via line 154 to gate 155.

If the temperature is above 55°C, the machine cycles which immediately follow the startup have a keep warm cycle of 40 ms. This is the same as the normal keep warm which occurs during non-fusing cycles. The shift register 121 and the generator 117 control this time as they do in normal nonfusing cycles. As will be appreciated, if the temperature is below 55°C the keep warm cycle is 5.6 times the nominal 20 ms. generator period or 112 ms. With the temperature in the fuser below 55°C a binary 1 level is applied by line 128 to the C input of register 121 and to an input of gate 121 (see FIG. 2). The binary 1 present on line 193 causes gate 129 to provide binary 1 levels to the D and E inputs of register 121. The A and B inputs of register 121 are at binary 1 levels because they are floating. Therefore, when a preset enable pulse occurs near the beginning of a machine cycle, all five stages of shift register 121 go to binary 1 levels and the fuser goes on. About 32 ms. later the first clock pulse from the generator 117 causes the register 121 to shift. After the first pulse, the generator pulses will occur at 20 ms. intervals. Since the serial input of the shift register is at a binary 0 level the $Q_A$ stage will go to a binary 0 level after the first clock. $Q_B$ will go to a binary 0 level on the second pulse, etc. On the fifth generator pulse $Q_E$ will go to a binary 0 level and turn off the fuser. It takes five clock pulses from the generator to turn off the fuser; however, the first generator pulse occurs at a time which is 1.6 times the period of the other cycles, thus the effective fuser on time is 5.6 times the period of the generator pulses.

The longer keep warm cycles continue until the first binary 1 reaches the $Q_E$ stage of shift register 66. At this time the binary 1 appears on line 196 and causes the output of NOR gate 197 to go to a binary 0 level. The upper input of NOR gate 198 is at a binary 0 level during startup, therefore, its output provides a binary 1 level and causes the fuser to go on. The fuser will remain on for the portion of the machine cycle allowed by the maximum on-time circuitry. Since the temperature in the fusing chamber is below 55° C this would be the full cycle of 330 ms. On the next machine cycle, the shift register will shift the binary 1 on stage $Q_E$ to $Q_F$. However, line 167 connects this level to gate 197 and this cycle will also turn on the fuser for the maximum on time per cycle limit. On the next machine cycle the binary 1 on $Q_F$ will shift to $Q_G$. This level is applied by line 153 to an input of NOR gate 185, and again this will turn on the fuser for the maximum allowable time set by the thermistor temperature. As each of these machine cycles have been occurring, the counter 150 has been counting from the initial load of 15 toward 24. On the next machine cycle the binary 1 on the $Q_G$ stage of shift register 66 will transfer to $Q_H$. This level will appear on the input of inverter 194 and resets the flip-flop formed by gates 190 and 191. The binary 0 on the input of gate 191 causes its output to go to a binary 1 level. With both inputs of gate 190 at binary 1 levels its output provides a binary 0 which appears on the input of gate 191. Thus, the output of gate 191 is held regardless of the state of inverter 194 or the shift register stage $Q_H$.

At this time the clear input of counter 150 and flip-flop 151 are enabled, the extra fusing cycles which were transmitted by gates 197 and 198 are inhibited in the future by the binary 1 which now appears, via line 154, on the input of gate 198. The binary 0 level on the output of gate 190 also inhibits extra fusing cycles on shift register 121. Gate 129 now has a binary 0 level on its upper input, and inputs D and E of shift register 15 are at binary 0 levels. The binary 1 on line 73 causes the support base to advance and during this cycle only a keep warm fusing pulse will be generated. The counter 150 has reached the count of 23, and the next binary 1 is a minimum of three cycles behind. Therefore, the maximum count of 24 will be reached.

When the next binary 1 occurs, the fusing sequence will be the same as described above except that the counter has a higher than normal count if it occurs within the next few machine cycles.

In summary, when the machine is operated there will be four warmup cycles. These cycles will be 5.6 times the generator period for temperatures in the fuser below 55° C or two times the generator period for temperatures above 55° C. These four cycles will be followed by three fusing cycles which are limited only by the maximum on time limit set by the thermistor, 330 ms., 280 ms., 230 ms., or 190 ms. In the following cycle the support base advances. These measures provide the maximum possible fusing heat without scorching the support base.

When the strip feed button is pressed the startup sequence proceeds in a manner very similar to that of a normal start run. The startup flip-flop 190 and 191 is set enabling the NOR gates 197 and 198 and gate 129 is enabled allowing longer keep warm cycles for temperatures below 55° C. More specifically, during strip feed line 55 provides a binary 0 level which also appears on line 63. As a result, a binary 1 level appears on the D input of flip-flop 65, and it will remain at this level as long as the button is pressed. As the machine cycles the Q output of flip-flop 65 will remain at a binary 1 level. This causes the shift register 66 to fill up with binary 1 on all its outputs. The first three cycles will have keep warm fusing cycles controlled by shift register 121. On the fourth cycle stage $Q_D$ of shift register 66 will go to a binary 1 level. This level will appear on an input of AND gate 201. Line 61 provides a binary 1 on gate 201 and causes the output of gate 201 to go to a binary 1 level. As described earlier, this turns on the fuser during startup. For the next three machine cycles the fuser will be kept on by the binary 1s in stages $Q_D$, $Q_E$, $Q_F$, and $Q_G$. Each of these cycles is still limited by the maximum on cycle time controlled by the thermistor temperature. In the following cycle the support base starts moving through the action of the gates 74 and 76. The fuser will remain on until the button is released. The shift register 66 will have binary 1s in all its outputs after the first 8 cycles. The flip-flop 190 and 191 will reset, but this will have no effect on the output because the high on the $Q_G$ stage of shift register 66 will keep the fuser on in each machine cycle. In summary, for strip feed the first three cycles will be keep warm and all others will be full fusing cycles until the button is released. These cycles will be limited only by the maximum on time per cycle.

It is to be understood that the description herein of a preferred embodiment, according to the invention, has been set forth as an example thereof and is not to be construed or interpreted as a limitation on the claims which follow and define the invention.

What is claimed is:

1. Apparatus comprising:

a. a source generating light images and print signals associated with at least some of the images, any one of the print signals being associated with only one of the images;

b. a support base;

c. toner;

d. means for providing toner images corresponding to light images associated with print signals, on successive sections of the support base;

e. a fuser assembly;

f. means, responsive to said print signals, for turning the fuser on for periods of time related to periodic intervals of time occurring between successive print signals, each of said periods of time occurring during an interval of time immediately prior to the presentation of a toner image, related to the first of the successive print signals, to the fuser assembly;

g. means for turning the fuser on upon presentation of a toner image to the fuser assembly; and h. means responsive to the temperature in the fuser for inhibiting means (f) and (g) to turn the fuser off after specific time periods within said intervals of time.

2. Apparatus as defined in claim 1 wherein the source generates the light images at a predetermined frequency and wherein the period of the predetermined frequency is equal to an interval of time.

3. Apparatus as defined in claim 2 wherein said fuser assembly includes a heating element, and further including means for periodically turning the fuser on for a length of time to keep the heating element warm, said length of time being dependent on the temperature in the fuser.

4. Apparatus as defined in claim 3 wherein said means for periodically turning the fuser on includes means for varying said length of time independently of the temperature in the fuser.

5. Apparatus as defined in claim 2 wherein said means for providing toner images includes means responsive to the print signals for advancing the support base a predetermined amount after a print signal occurs and means for advancing sections of the support base at said predetermined frequency without regard to the presence or absence of print signals.

6. Apparatus as defined in claim 2 wherein said means responsive to the temperature in the fuser includes means for sensing the temperature in the fuser and for providing binary signals related to the sensed temperature and means responsive to the binary signals for inhibiting means (f) and (g).

7. Apparatus as defined in claim 2 wherein said means (f) include an up-down counter, the counter counting up the periodic intervals of time occurring between successive print signals and counting down at a rate which is higher than the rate of said periodic intervals.

8. Apparatus as defined in claim 7 wherein the count down rate of the counter is independently variable.

9. Apparatus as defined in claim 7 wherein said fuser assembly includes a heating element, and further including means for periodically turning the fuser on for a length of time do keep the heating element warm, said length of time being dependent on the temperature in the fuser.

10. Apparatus as defined in claim 7 wherein said means for providing toner images includes means responsive to the print signals for advancing the support base a predetermined amount after a print signal occurs and means for advancing sections of the support base at said predetermined frequency without regard to the presence or absence of print signals.

11. Apparatus as defined in claim 7 wherein said means responsive to the temperature in the fuser includes means for sensing the temperature in the fuser and for providing binary signals related to the sensed temperature and means responsive to the binary signals for inhibiting means (f) and (g).

* * * * *